US012221737B2

(12) United States Patent
Seo et al.

(10) Patent No.: US 12,221,737 B2
(45) Date of Patent: Feb. 11, 2025

(54) WASHING MACHINE APPLIANCES WITH HUMIDITY MEASUREMENT

(71) Applicant: Haier US Appliance Solutions, Inc., Wilmington, DE (US)

(72) Inventors: Wonmyung Seo, Seongnam (KR); Seong Hoon Ryu, Suwon (KR); Han Young Kim, Seongnam (KR); Jaewon Jo, Seongnam (KR); Jisoo Kim, Seongnam (KR); Je Kwon Yoon, HwangSeong (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/902,015

(22) Filed: Sep. 2, 2022

(65) Prior Publication Data

US 2024/0076821 A1 Mar. 7, 2024

(51) Int. Cl.

| | |
|---|---|
| ***D06F 33/47*** | (2020.01) |
| ***D06F 33/74*** | (2020.01) |
| ***D06F 34/26*** | (2020.01) |
| *D06F 25/00* | (2006.01) |
| *D06F 34/08* | (2020.01) |
| *D06F 103/34* | (2020.01) |
| *D06F 103/68* | (2020.01) |

(52) U.S. Cl.

CPC ..... *D06F 33/47* (2020.02); *D06F 33/74* (2020.02); *D06F 34/26* (2020.02); *D06F 25/00* (2013.01); *D06F 34/08* (2020.02); *D06F 2103/34* (2020.02); *D06F 2103/68* (2020.02)

(58) Field of Classification Search

CPC ..... D06F 33/47; D06F 33/74; D06F 25/00; D06F 34/26

See application file for complete search history.

(56) References Cited

U.S. PATENT DOCUMENTS

| | | | | |
|---|---|---|---|---|
| 9,249,539 | B2 | 2/2016 | Hubig et al. | |
| 10,808,351 | B1 * | 10/2020 | Flachsbart | G01K 13/00 |
| 2004/0200093 | A1 * | 10/2004 | Wunderlin | D06F 34/08 34/606 |
| 2009/0006970 | A1 * | 1/2009 | Jeffery | D06F 34/05 715/733 |

(Continued)

FOREIGN PATENT DOCUMENTS

| | | | | |
|---|---|---|---|---|
| CN | 102656315 A | * | 9/2012 | D06F 58/10 |
| JP | H11290593 A | | 10/1999 | |

(Continued)

OTHER PUBLICATIONS

Machine translation of KR-20060089072-A , dated Aug. 2006. (Year: 2006).*

(Continued)

*Primary Examiner* — Joseph L. Perrin
*Assistant Examiner* — Kevin G Lee
(74) *Attorney, Agent, or Firm* — Dority & Manning, P.A.

(57) ABSTRACT

A method of operating a washing machine appliance includes measuring a humidity value with the humidity sensor and comparing the measured humidity value to an expected humidity value. The method also includes flagging a fault in response to the measured humidity value differing from the expected humidity value by at least a predetermined threshold.

16 Claims, 8 Drawing Sheets

(56) References Cited

U.S. PATENT DOCUMENTS

| | | | | |
|---|---|---|---|---|
| 2012/0124859 | A1* | 5/2012 | May | D06F 34/28 34/572 |
| 2013/0104607 | A1* | 5/2013 | Broitzman | D06F 37/04 68/13 R |
| 2016/0218884 | A1* | 7/2016 | Ebrom | H04L 12/2816 |

FOREIGN PATENT DOCUMENTS

| | | | | |
|---|---|---|---|---|
| KR | 2005122468 | A * | 12/2005 | |
| KR | 100587358 | B1 | 6/2006 | |
| KR | 2006089072 | A * | 8/2006 | D06F 25/00 |
| KR | 2006120883 | A | 11/2006 | |

OTHER PUBLICATIONS

Machine translation of CN-102656315-A, dated Sep. 2012. (Year: 2012).*

Machine translation of KR-2005122468-A, dated Dec. 29, 2005. (Year: 2005).*

* cited by examiner

WASHING MACHINE APPLIANCES WITH HUMIDITY MEASUREMENT

FIELD OF THE INVENTION

The present subject matter relates generally to washing machine appliances, and more particularly to washing machine appliances having one or more humidity sensors, including features and methods for evaluating the functionality of such sensors.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Some washing machine appliances include humidity sensors for monitoring humidity levels in and/or around the washing machine appliance. Such washing machine appliances typically provide minimal, if any, diagnostics of the humidity sensors, such as only verifying that the humidity sensors are actually functioning without verifying the accuracy of the measurements.

As a result, further advances are desired in the art to improve performance and accuracy of humidity monitoring within washing machine appliances.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The washing machine appliance has a cabinet, a wash tub positioned within the cabinet, and a wash basket rotatably mounted within the wash tub. The washing machine appliance also includes a humidity sensor positioned and configured to measure a humidity within the wash tub. The method includes measuring a humidity value with the humidity sensor and comparing the measured humidity value to an expected humidity value. The method also includes flagging a fault in response to the measured humidity value differing from the expected humidity value by at least a predetermined threshold.

In another exemplary aspect of the present disclosure, a washing machine appliance is provided. The washing machine appliance has a cabinet, a wash tub positioned within the cabinet, and a wash basket rotatably mounted within the wash tub. The washing machine appliance also includes a humidity sensor positioned and configured to measure a humidity within the wash tub. The washing machine appliance also include a controller. The controller is operable for measuring a humidity value with the humidity sensor and comparing the measured humidity value to an expected humidity value. The controller is further operable for flagging a fault in response to the measured humidity value differing from the expected humidity value by at least a predetermined threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
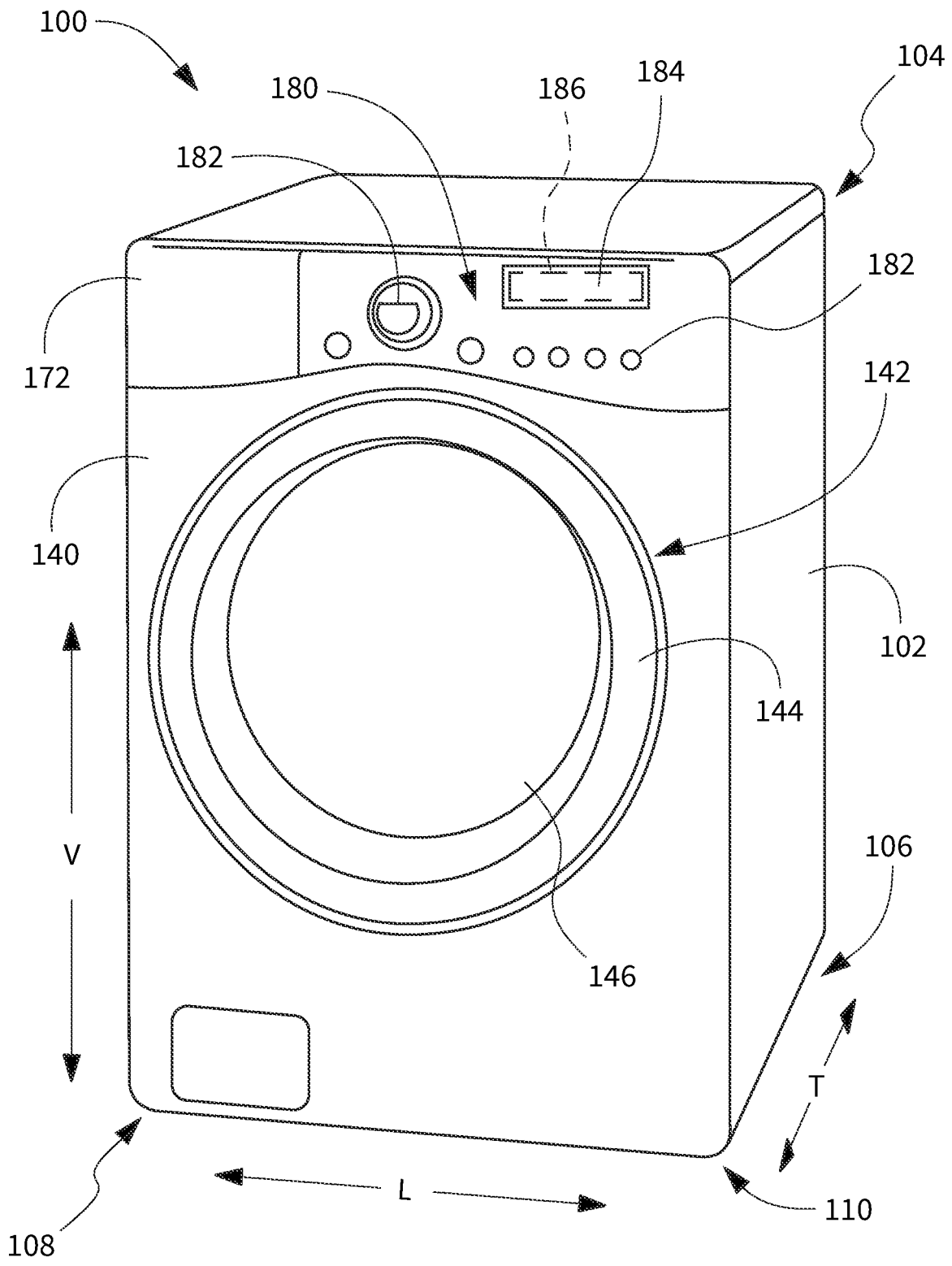
FIG. 1 provides a perspective view of a washing machine appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back," "top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
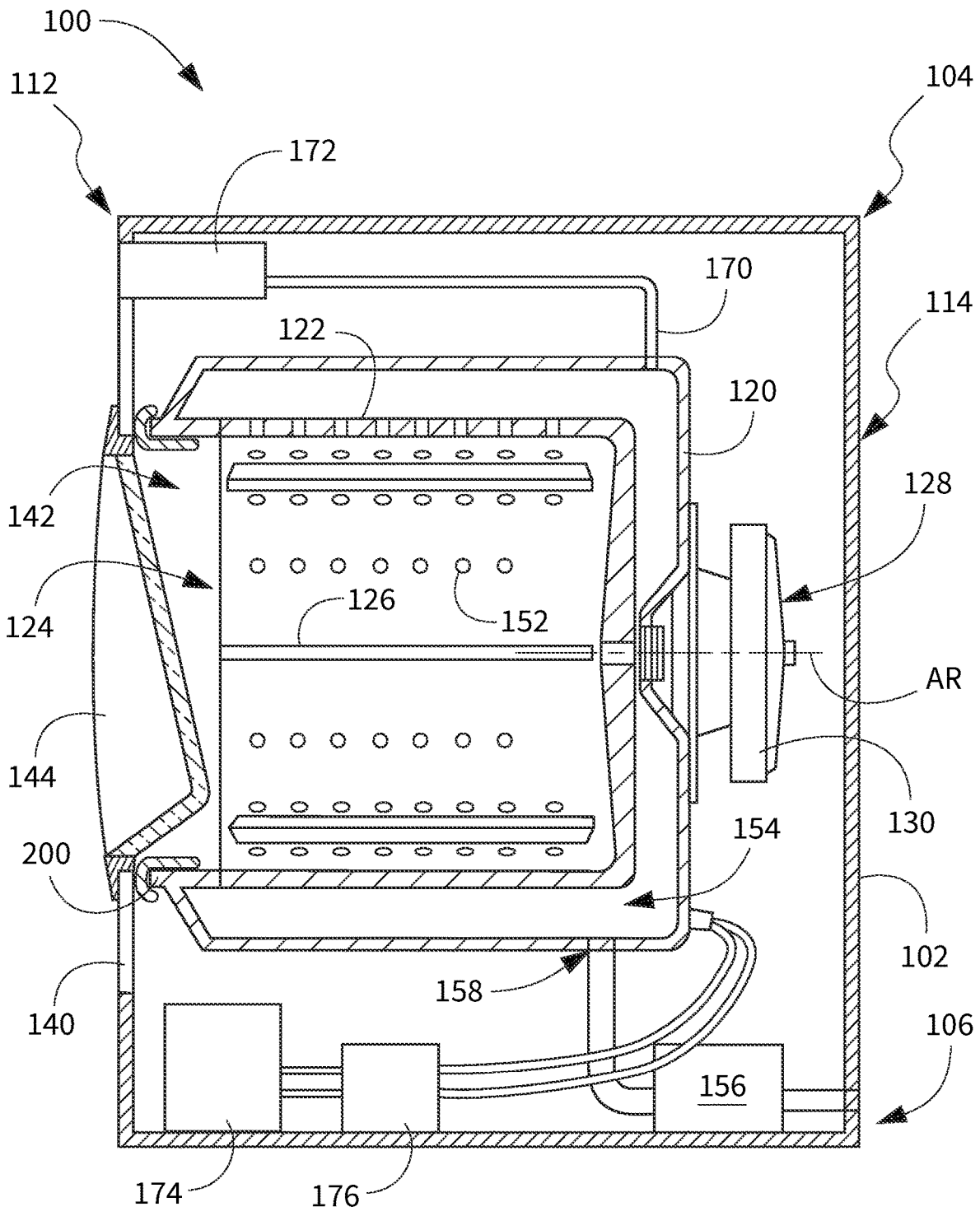
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably, e.g., pivotably, mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120. For example, when the door 144 is in the closed position, the wash tub 120 may be generally enclosed (e.g., at least 90% enclosed and at least 90% surrounded on all sides, such as fully enclosed with the exception of a vent line 190 and/or vent aperture 202 as will be described below) by the door 144 and the cabinet 102. A gasket 200 may be provided in the opening 142 and the gasket 200 may sealingly engage the door 144 when the door 144 is in the closed position. For example, the gasket 200 may extend between the tub 120 and the front panel 140, e.g., generally along the transverse direction T and may extend about or around the opening 142 such that the gasket 200 is covered by the door 144 when the door 144 is in the closed position, and the gasket 200 may promote sealing between the door 144 and the cabinet 102, e.g., the front panel 140 of the cabinet 102.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120. Accordingly, pump assembly 156 may also be referred to or include a drain pump and/or a circulation pump.

Referring still to FIGS. 1 and 2, in some embodiments, washing machine appliance 100 may include an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to and/or receive signals from the controller 186.

In addition, the memory or memory devices of the controller 186 can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 186 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 186 as disclosed herein is capable of and may be operable to perform any methods, method steps, or portions of methods as disclosed herein. For example, in some embodiments, methods disclosed herein may be embodied in programming instructions stored in the memory and executed by controller 186.

The memory devices may also store data that can be retrieved, manipulated, created, or stored by the one or more processors or portions of controller 186. The data can include, for instance, data to facilitate performance of methods described herein. The data can be stored locally (e.g., on controller 186) in one or more databases and/or may be split up so that the data is stored in multiple locations. In addition, or alternatively, the one or more database(s) can be connected to controller 186 through any suitable network(s), such as through a high bandwidth local area network (LAN) or wide area network (WAN). In this regard, for example, controller 186 may further include a communication module or interface that may be used to communicate with one or more other component(s) of washing machine appliance 100, controller 186, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation AR at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

During such operations, the gasket 200 may help to contain wash fluid within the cabinet 102, particularly within the tub 120. As generally shown in FIG. 2, the gasket 200 may be positioned between the door 144 and the tub 120, e.g., when the door 144 is in the closed position as in FIG. 2. Thus, the gasket 200 may sealingly engage the door 144 when the door 144 is in the closed position. In general, the gasket 200 sealingly engages the cabinet 102, in particular the opening 142 thereof, the tub 120, and the door 144. For example, the gasket 200 may extend around the opening 142 along a perimeter, e.g., circumference, of the opening 142 and may extend between the cabinet 102 and the wash tub 120 along a longitudinal axis, such as along or generally parallel to the transverse direction T.

It should be appreciated that the present subject matter is not limited to any particular style, model, or configuration of washing machine appliance. The exemplary embodiment depicted in FIGS. 1 and 2 is simply provided for illustrative purposes only. While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well. For example, different locations may be provided for the user interface, different configurations may be provided, e.g., vertical axis washing machines, and other differences may be applied as well.

Figure 3:
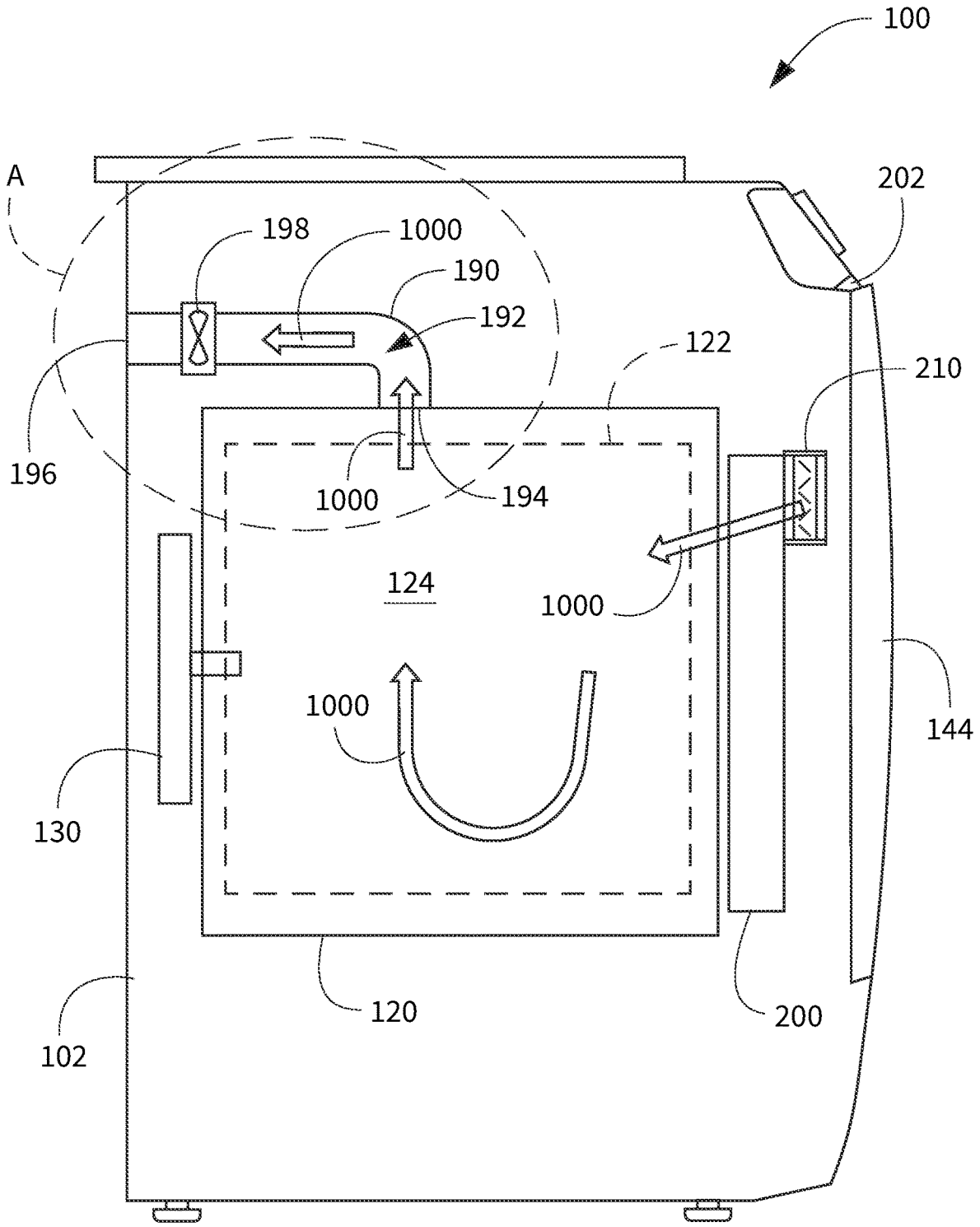
FIG. 3 provides a schematic side view of an exemplary washing machine appliance according to one or more exemplary embodiments of the present disclosure.

As illustrated in FIG. 3, in some embodiments, a ventilation line 190 is provided within washing machine appliance 100. In particular, ventilation line 190 may be enclosed within cabinet 102. As shown in FIG. 3, exemplary embodiments include ventilation line 190 at a position in fluid communication between tub 120 and the surrounding region (e.g., the ambient environment outside of or immediately surrounding cabinet 102, the enclosed volume of cabinet 102 surrounding tub 120, etc.). Generally, it is understood that ventilation line 190 may be provided as any suitable pipe or conduit (e.g., having non-permeable wall) for directing air therethrough. When assembled, ventilation line 190 defines an air path 192 from tub 120 and within or through cabinet 102 (e.g., to the ambient environment outside of cabinet 102). Specifically, air path 192 extends from a ventilation inlet 194, through cabinet 102, and to a ventilation outlet 196. In some embodiments, ventilation inlet 194 is defined through a top portion of wash tub 120 and ventilation outlet 196 is defined through an upper portion of cabinet 102. Thus, air path 192 may extend from the top portion of tub 120 to an upper portion of cabinet 102. Optionally, ventilation inlet 194 may be positioned below ventilation outlet 196 along a vertical direction V. Advantageously, a convective airflow may be naturally motivated from wash tub 120, through air path 192, and to the ambient environment. Also, such airflow may be aided or urged through the washing machine appliance 100 by rotating the wash basket 122.

Although a convective airflow may be facilitated, optional embodiments further include a fan or blower 198. Specifically, fan 198 may be provided in fluid communication with ventilation line 190 to motivate an active airflow therethrough. For instance, fan 198 may be mounted within ventilation line 190 to selectively rotate and draw air from wash tub 120, through ventilation inlet 194, and to ventilation outlet 196 (e.g., to output an airflow from tub 120 to the ambient environment).

A cabinet aperture 202 may be defined through front panel 140 as an inlet for ambient air to flow from outside of the cabinet 102 to the inside of the cabinet 102, e.g., to and through the tub 120. Notably, in the disclosed embodiments, air 1000 (e.g., an ambient airflow) may flow between tub 120 and the ambient environment through cabinet aperture 202 and/or vent line 190 even while door 144 remains closed.

A vent damper 210 may be provided to selectively control an airflow between tub 120 and, for example, the ambient environment. Generally, vent damper 210 is in communication with wash tub 120 and/or ventilation line 190 (i.e., in fluid communication with air path 192). In certain embodiments, vent damper 210 is enclosed, at least in part, within cabinet 102. Vent damper 210 may be selectively controlled or operated to limit or obstruct the flow of air from the ambient environment into the interior of the cabinet 102, such as to the wash tub 120, via the aperture 202 during certain operations, phases, or cycles. Thus, vent damper 210 may selectively limit airflow between tub 120 and the ambient environment, such as airflow from the ambient environment via the aperture 202.

The damper 210 may be positioned downstream of the aperture 202, e.g., between the aperture 202 and the wash tub 120 and/or between the aperture 202 and the gasket 200. Thus, opening the damper 210 may permit fluid communication, e.g., air flow, between internal components of the washing machine appliance 100, e.g., the wash tub 120 and/or the wash basket 122, and the ambient environment external to the cabinet 102. Thus, the damper 210 may be upstream of the internal components, e.g., wash basket 122, with respect to a flow of ambient air 1000 from the ambient environment external to the cabinet 102 through the washing machine appliance 100. As may be seen in FIG. 3, the flow of ambient air 1000 from the ambient environment external to the cabinet 102 through the washing machine appliance 100 may enter the washing machine appliance 100 through the aperture 202, flow through the damper 210, into and through the wash tub 120, e.g., wash basket 122 and wash chamber 124 therein, and may exit the washing machine appliance 100 via the vent line 190, e.g., by flowing into the vent line 190 at the ventilation inlet 194 from the wash tub 120, flowing through the vent line 190, and returning to the ambient environment from the vent line 190 via the ventilation outlet 196. In some embodiments, such air flow may be aided or urged by fan 198. In additional embodiments, the air flow through the washing machine appliance 100, as illustrated by arrows 1000, may be provided by convective flow and/or rotation of the wash basket 122 without the use or presence of a fan. Such rotation of the wash basket 122, including the ribs 126 therein, may push the air 1000 around to promote circulation of the ambient air 1000 through the washing machine appliance 100, e.g., into and through the wash basket 122. In some embodiments, the fan 198 may not be included, and the flow of ambient air 1000 through the washing machine appliance 100 may be provided solely by natural convection and/or rotation of the wash basket 122.

Figure 4:
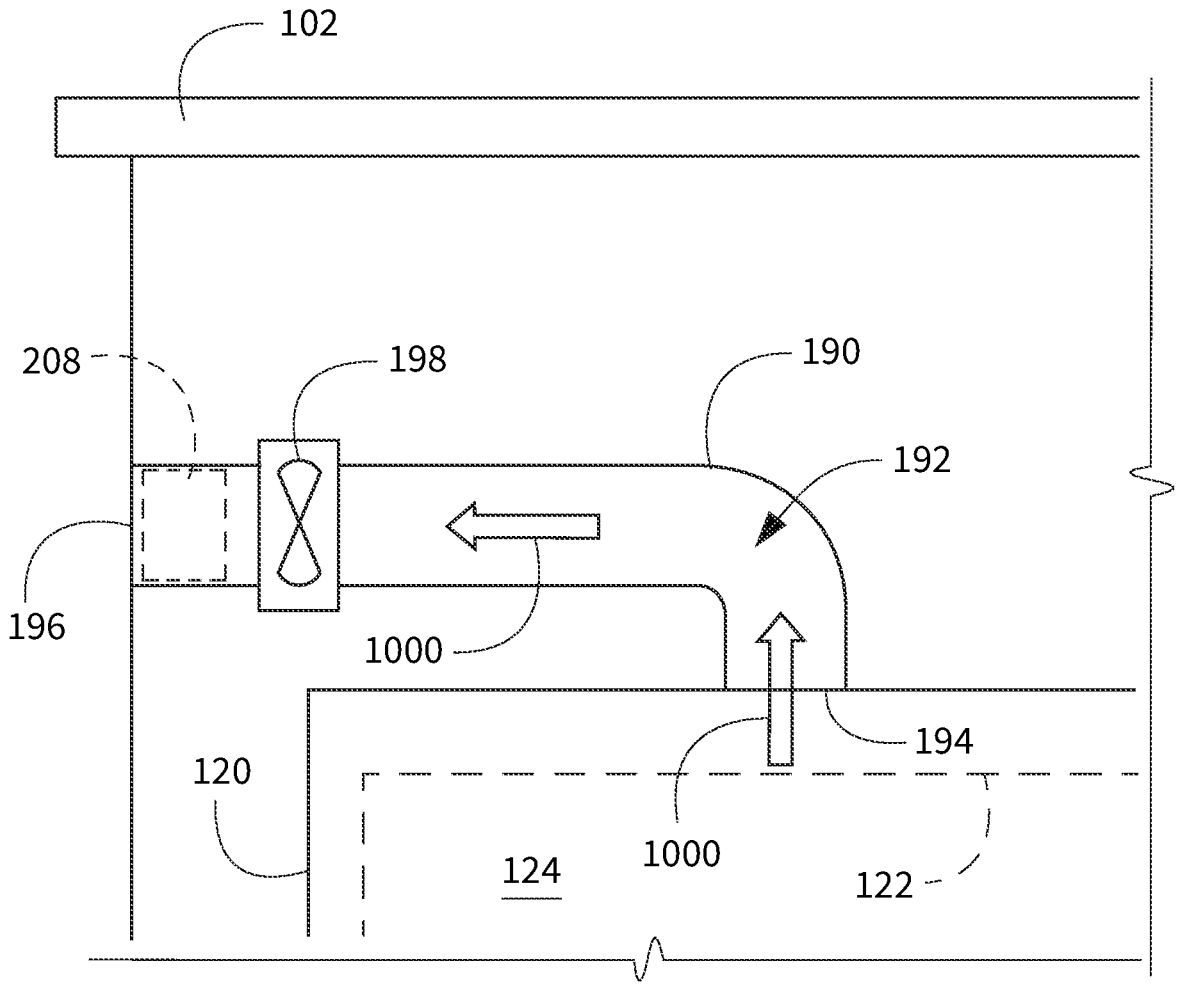
FIG. 4 provides an enlarged view of a portion of the washing machine appliance of FIG. 3 according to one or more exemplary embodiments of the present disclosure.
Figure 5:
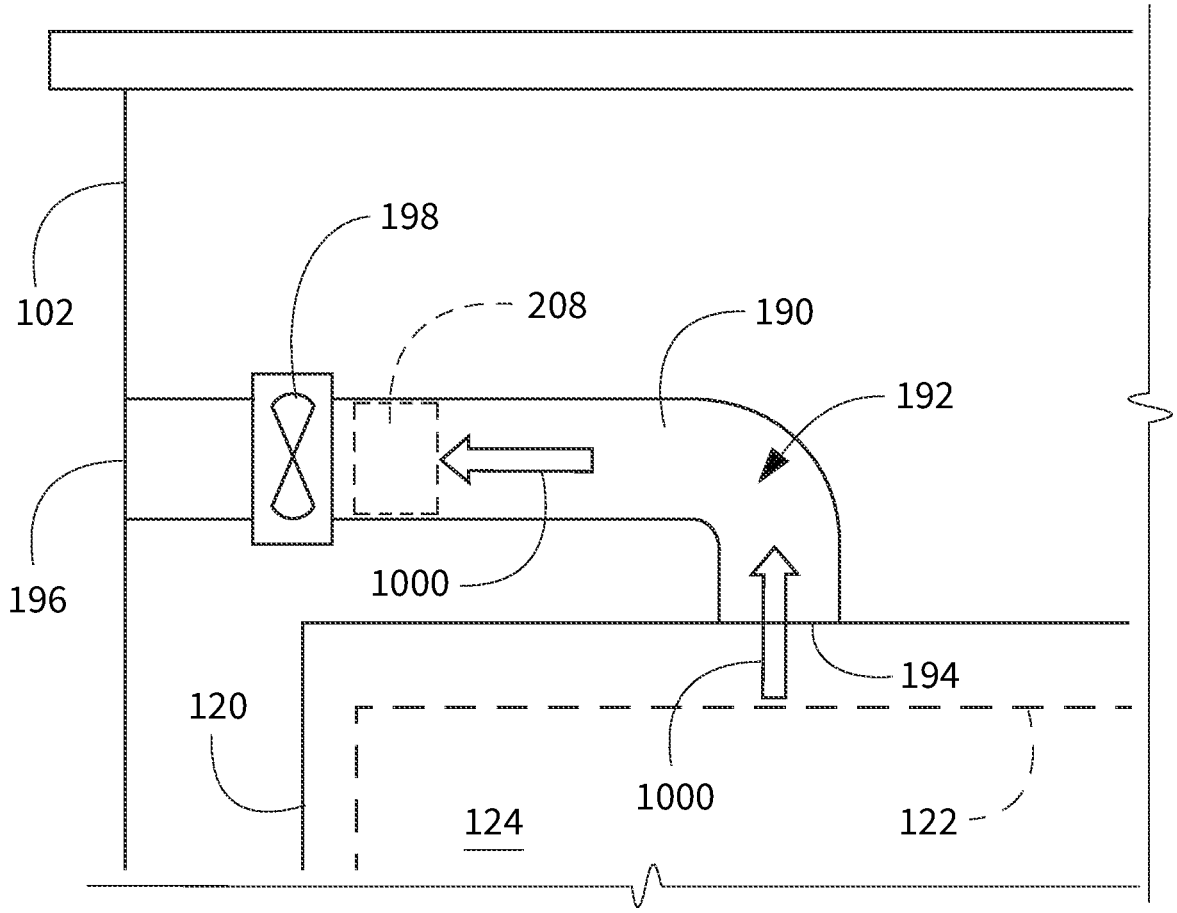
FIG. 5 provides an enlarged view of a portion of the washing machine appliance of FIG. 3 according to one or more additional exemplary embodiments of the present disclosure.
Figure 6:
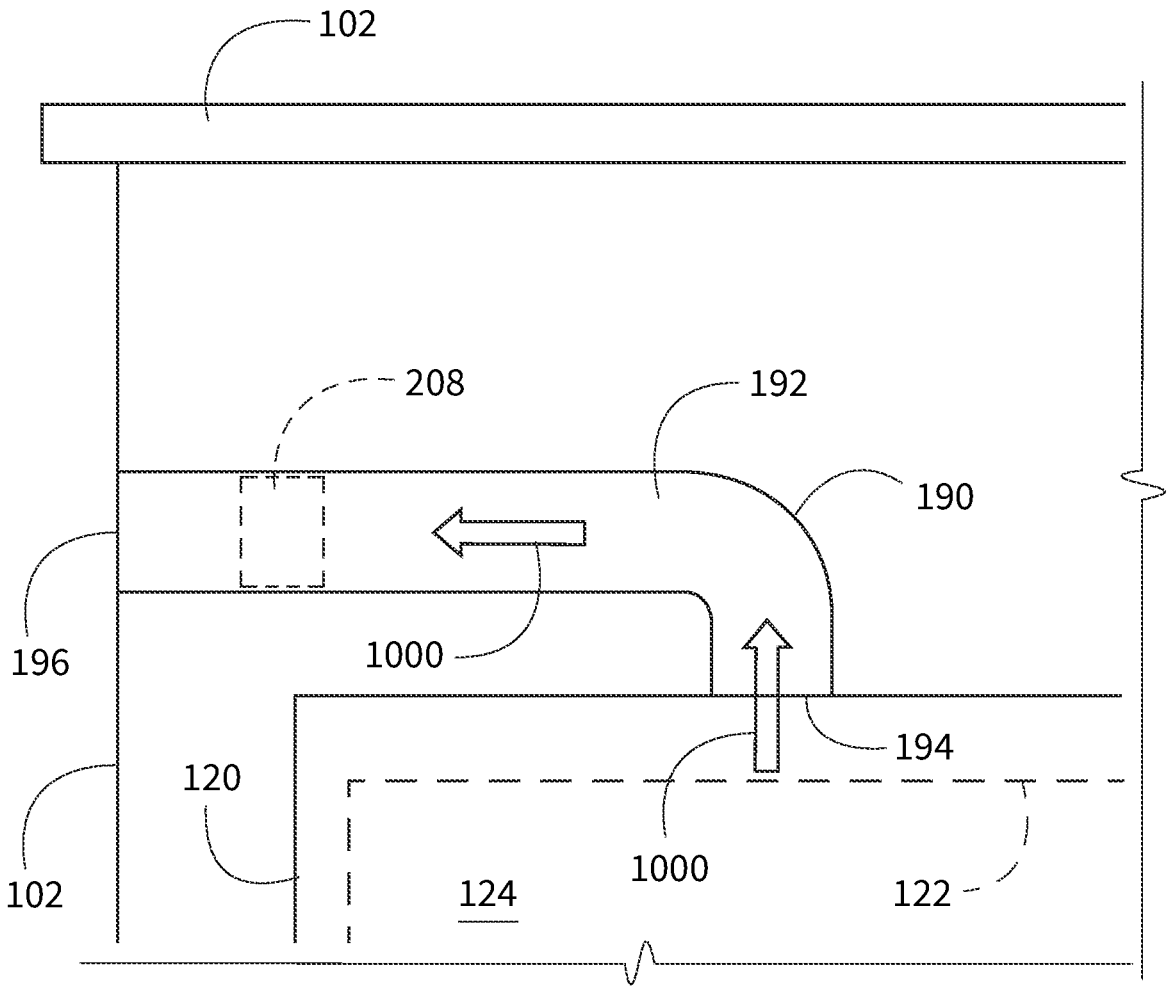
FIG. 6 provides an enlarged view of a portion of the washing machine appliance of FIG. 3 according to one or more further exemplary embodiments of the present disclosure.

FIGS. 4-6 illustrate enlarged views of a portion of the washing machine appliance 100 of FIG. 3, the portion is generally indicated by the oval A in FIG. 3. As illustrated in FIGS. 4-6, the washing machine appliance 100 may also include a humidity sensor 208. In some embodiments, the humidity sensor 208 may be a single humidity sensor 208, e.g., may be the only humidity sensor provided in the washing machine appliance 100, and may be operable to measure both an internal humidity level, e.g., a humidity within the washing machine appliance 100 (such as within the cabinet 102 thereof, such as within the wash tub 120 and/or wash basket 122) and a external humidity level, e.g., a humidity outside of the cabinet 102, such as a humidity of an ambient environment external to the cabinet 102. Humidity sensor 208 may be positioned in any suitable location within washing machine appliance 100. Humidity sensor 208 may be any suitable sensor capable of sensing or measuring the humidity or relative humidity in the air. For instance, humidity sensor 208 may be a capacitive, resistive, or thermal sensor.

As mentioned above, the controller 186 may be in operative communication with various other components of the washing machine appliance 100. In particular, controller 186 is in operative communication with humidity sensor 208, fan 198 (when the fan 198 is provided), damper 210, and motor 130. Accordingly, controller 186 may receive signals from and route signals to these various components. For instance, controller 186 may receive signals from humidity sensor 208 that are indicative of the humidity or relative humidity of the air measured by the humidity sensor 208. Such signals may be used to make decisions as to whether to activate motor 130 to rotate wash basket 122, e.g., to facilitate air flow through the wash tub 120. Controller 186 can receive the signals directly or indirectly from sensor 208. Moreover, controller 186 may send signals to motor 130, e.g., to rotate basket 122, to fan 198, e.g., to blow air within and/or through vent line 190, or controller 186 may send signals to damper 210 to open or close.

In some embodiments, e.g., as illustrated in FIG. 4, humidity sensor 208 may be positioned proximate the ambient environment, such as proximate the ventilation outlet 196. For example, in embodiments which include the fan 198, the humidity sensor 208 may be proximate the ambient environment in that the humidity sensor 208 is downstream of the fan 198, e.g., is between the fan 198 and the ventilation outlet 196. As another example, the humidity sensor 208 may be proximate the ambient environment in that the humidity sensor 208 is closer to the ventilation outlet 196 than to the ventilation inlet 194, such as, where a length of the ventilation line 190 is defined from the ventilation inlet 194 to the ventilation outlet 196, the humidity sensor 208 may be positioned at the ventilation outlet 196 or separated from the ventilation outlet 196 by a distance which is ten percent or less of the length of the ventilation line 190. In such embodiments, the humidity sensor 208 may be operable to measure ambient humidity whenever the washing machine appliance 100 is idle, e.g., when the washing machine appliance 100 is not performing a cycle such as a wash cycle. In particular, it may be advantageous to measure the ambient humidity when the washing machine appliance 100 is idle prior to the first wash cycle of the day, and such ambient humidity measurement may be stored or recorded, e.g., in a memory of the controller 186.

In some embodiments, e.g., as illustrated in FIGS. 5 and 6, humidity sensor 208 may be positioned inside the vent line 190 and away from the ambient environment. For example, in embodiments such as FIG. 5 which include the fan 198, the humidity sensor 208 may be away from the ambient environment in that the humidity sensor 208 is upstream of the fan 198, e.g., where the fan 198 is between the humidity sensor 208 and the ventilation outlet 196, such that the humidity sensor 208 is separated from the ambient environment by the fan 198. As another example, the humidity sensor 208 may be away from the ambient environment in that the humidity sensor 208 is separated from the ventilation outlet 196 by a distance which is more than ten percent of the length of the ventilation line 190. In such embodiments, the humidity sensor 208 may be operable to measure ambient humidity whenever the washing machine appliance 100 is idle, assuming that the ambient humidity and the humidity inside the washing machine appliance are approximately the same given sufficient time to equilibrate after a most recent wash cycle. In particular, it may be advantageous to measure the ambient humidity when the washing machine appliance 100 is idle prior to the first wash cycle of the day in order to ensure sufficient time for the humidity to equilibrate, and such ambient humidity measurement may be stored or recorded, e.g., in a memory of the controller 186.

Additionally, in at least some embodiments, in particular those embodiments where the humidity sensor 208 is positioned away from the outlet 196, the humidity sensor 208 may be operable to measure the ambient humidity when ambient air is drawn into the vent line 190, e.g., in the reverse direction of the normal air flow path through the washing machine appliance 100. For example, in embodiments which include the fan 198, the fan 198 may be operable in two directions, e.g., may be a reversible fan, whereby the fan 198 may be operable to spin in a reverse direction in order to draw ambient air into the vent line 190 via the ventilation outlet 196, whereby the humidity sensor 208 may measure an ambient humidity when the fan 198 is operating in the reverse direction. In additional embodiments, such as but not limited to embodiments where there is no fan in the vent line 190, e.g., as illustrated in FIG. 6, the washing machine appliance 100 may be operable to draw ambient air in through the ventilation outlet 196 (which, as noted above, is opposite the normal flow direction of the flow of air through the washing machine appliance 100) when the door 144 is closed, by closing the damper 210 and activating the pump assembly 156, e.g., activating a drain pump. With the door 144 and the damper 210 both closed, the vent line 190 is the only point of ingress or egress for air to or from the interior of the washing machine appliance 100. Thus, activating the pump creates a negative pressure within the wash tub 120, thereby drawing ambient air in through the vent line 190, e.g., past the humidity sensor 208 whereby the humidity sensor 208 may measure an ambient humidity when the door 144 and the damper 210 are both closed and the pump 156 is activated.

In some embodiments, the washing machine appliance 100 may include more than one humidity sensor, e.g., a second humidity sensor. In such embodiments, the second or other additional humidity sensor may be positioned proximate to the damper 210, such as immediately upstream or immediately downstream of the damper 210, e.g., between the damper 210 and the gasket 200 or between the damper 210 and the aperture 202. In such embodiments, exemplary methods of evaluating the humidity sensor may be used to evaluate either or both of the first humidity sensor and the second humidity sensor.

As mentioned above, the flow of ambient air 1000 (e.g., FIG. 3) through the washing machine appliance 100 may be facilitated by rotating the wash basket 122. In some embodiments, such rotation may include, e.g., during a ventilation cycle, rotating the basket 122 for an ON period followed by stopping the basket 122 for an OFF period. In various embodiments, the rotational speed during the ON period or periods may be any suitable speed, such as between about 50 revolutions per minute (RPM) and about 200 RPM, such as about 150 RPM or about 100 RPM. The rotational speed during the ON period may be generally constant, e.g., apart from an inherent acceleration time to reach the set speed. As is understood, the rotational speed is zero during the OFF period.

Figure 7:
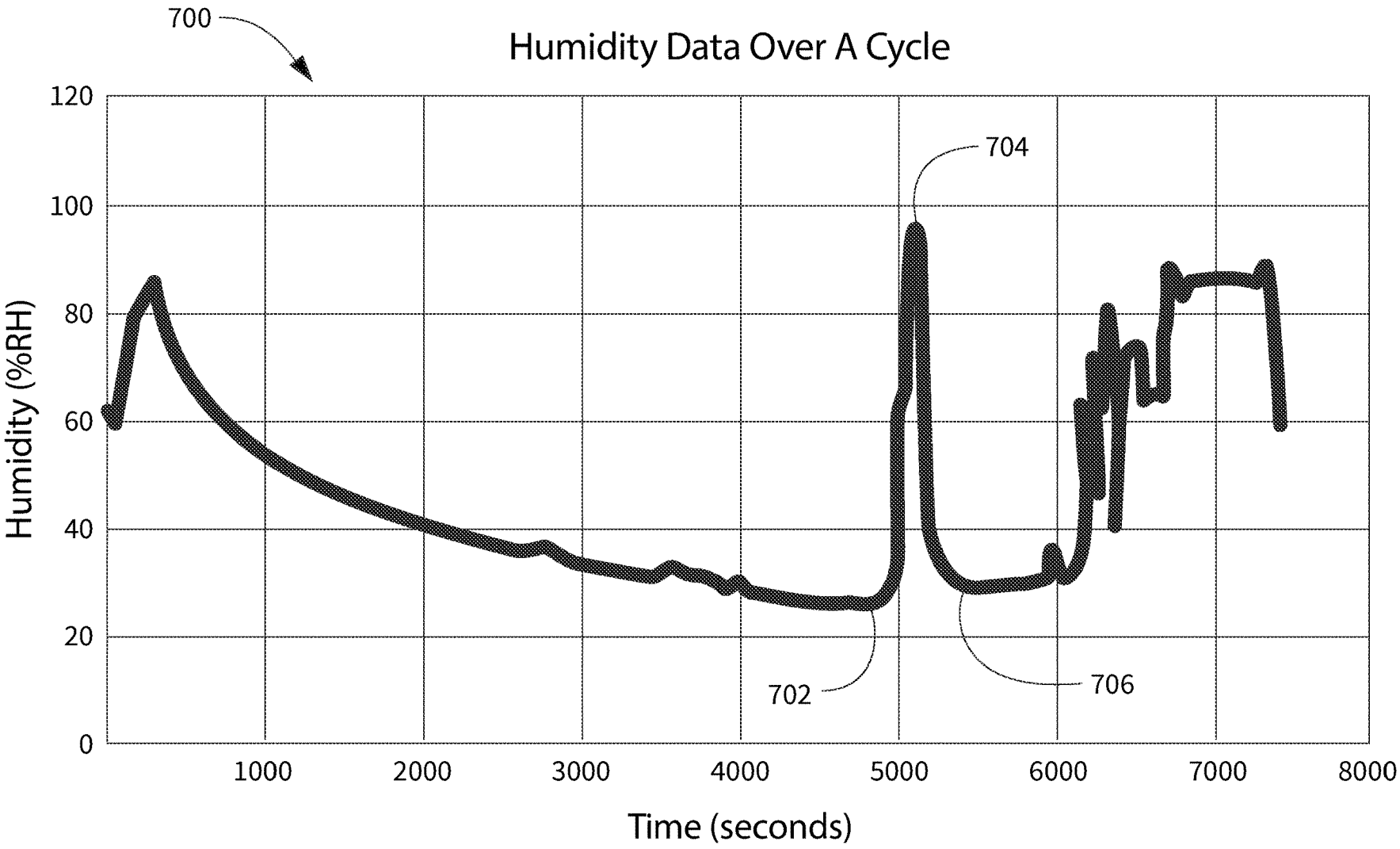
FIG. 7 provides a graph of exemplary humidity values during a washing machine appliance operation according to one or more exemplary embodiments of the present disclosure.

FIG. 7 provides a plot 700 of measured humidity values over time during an exemplary washing operation of a washing machine appliance, such as but not limited to the exemplary washing machine appliance 100 described above. The exemplary washing operation represented by plot 700 includes a fill stage and a soak stage, e.g., where the humidity within the washing machine appliance increases at and/or near the beginning of the washing operation. As may be seen in FIG. 7, the humidity may generally decrease over time at least through a first portion of the washing operation, e.g., beginning at a drain stage following the soak stage. For example, the humidity may generally decrease over time throughout the wash cycle and rinse cycle of the washing operation, e.g., prior to a spin cycle of the washing operation. As illustrated in FIG. 7, the humidity may reach a first inflection point 702, e.g., at the start of a first spin cycle of the washing operation. Following the first inflection point 702, the humidity value may be a spike 704, e.g., a large and rapid increase in humidity, such as a humidity over time with a large positive slope, such as a slope of between about sixty degrees and about ninety degrees (referring to standard measuring convention wherein, e.g., zero degrees would be flat and to the right and one hundred eighty degrees would be flat and to the left, etc.). For example, the spike 704 may correspond to an increase in humidity of at least about thirty percentage points in about three hundred seconds or less. The increase in humidity during the spike may be, for example, an increase in humidity of between about thirty five percentage points and about eighty percentage points, such as between about forty percentage points and about seventy five percentage points, such as between about forty five percentage points and about seventy percentage points, such as between about fifty percentage points and about sixty five percentage points. Also by way of example, the increase may occur over a time period (e.g., the time to the peak of the spike 704) of between about two hundred fifty seconds and about sixty seconds, such as between about two hundred seconds and about one hundred seconds, such as about one hundred fifty seconds.

Figure 8:
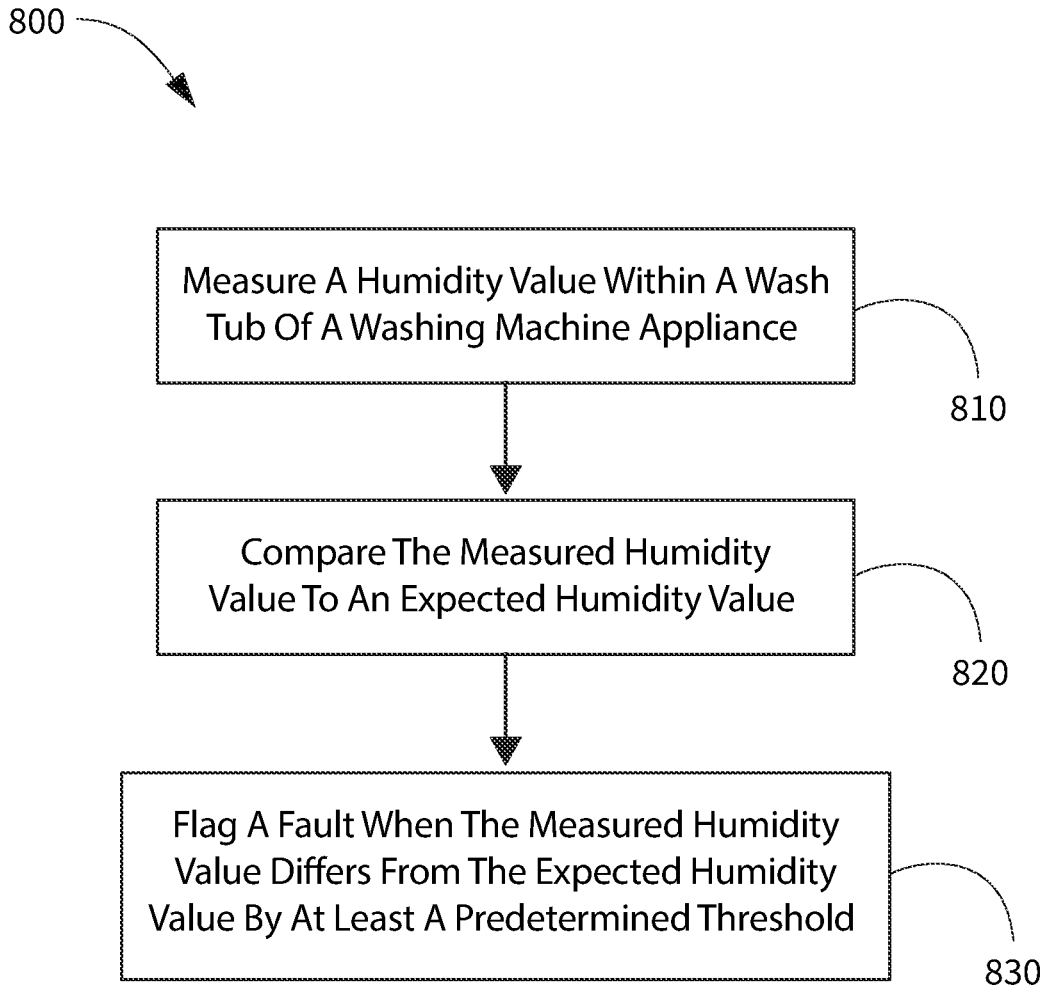
FIG. 8 provides a flow diagram of an exemplary method of operating a washing machine appliance according to one or more exemplary embodiments of the present disclosure.

FIG. 8 provides a flow diagram of an exemplary method 800 of operating a washing machine appliance, according to one or more exemplary embodiments of the present disclosure. Method 800 may be implemented using any suitable appliance, including for example, horizontal axis washing machine appliance 100 of FIGS. 1 and 2. Accordingly, to provide context to method 800, reference numerals utilized to describe the features of washing machine appliance 100 in FIGS. 1 and 2 will be used below.

The method 800 may be begun or commenced in various ways. For example, method 800 may be performed during a wash cycle, or after or between wash cycles of washing machine appliance 100. For example, the method 800 may be performed after wash liquid has been introduced into the wash tub, or the method 800 may include a step of flowing a liquid into the tub, e.g., where the expected humidity response correlates to a drying process as such liquid is removed. The method 800 may be commenced in a number of suitable ways. For instance, a user may manually commence the method 800. For example, a user may manipulate one or more input selectors 182 of control panel 180. As another example, a user may activate the method 800 by utilizing an application on a remote user device, e.g., smartphone, tablet, etc., communicatively coupled with controller 186 of washing machine appliance 100. Another suitable manner for commencing the method 800 includes automatically commencing the method 800 without a specific user input. For example, the method 800 may be commenced automatically at a predetermined interval, such as, e.g., every week, every month, etc. As another example, the method 800 may be commenced automatically during each cycle of the washing machine appliance, or every Nth cycle of the washing machine appliance. In this manner, the method 800 may be performed without user interaction with washing machine appliance 100 and it may be ensured that the functionality and accuracy of the humidity sensor is verified or checked at regular intervals. Yet another suitable manner for commencing the method 800 includes embedding the method 800 into another cycle, such as, e.g., a special diagnostic cycle which is overall shorter in duration than a wash cycle of the washing machine appliance, e.g., where components are activated sequentially during the diagnostic cycle only for as long as needed to gather test data related to the functionality of such components, e.g., the motor, the humidity sensor, and/or other components in various combinations.

As mentioned, method 800 may be implemented using any suitable washing machine appliance, such as a washing machine appliance including a cabinet, a wash tub positioned within the cabinet, a wash basket rotatably mounted within the wash tub, and a humidity sensor positioned and configured to measure a humidity within the wash tub. As illustrated in FIG. 8, the method 800 may include a step 810 of measuring a humidity value with the humidity sensor. The method 800 may further include a step 820 of comparing the measured humidity value to an expected humidity value and a step 830 of flagging a fault in response to the measured humidity value differing from the expected humidity value by at least a predetermined threshold. Thus, the fault may indicate that the humidity sensor, although functional, is not functioning accurately, e.g., is not accurately measuring the humidity in the wash tub. As such, method 800 may advantageously provide an improved humidity sensor evaluation in a washing machine appliance, e.g., evaluating the accuracy of the measurements taken by the humidity sensor instead of only verifying the basic functionality of the humidity sensor.

As mentioned, controller 186 may be operable to measure air humidity, e.g., by receiving a signal indicative of a relative humidity of the air within the washing machine appliance 100. Based on the signals received, controller 186 may determine the relative humidity of such air. Thus, for example, the foregoing steps such as step 810 may be performed by controller 186.

In some exemplary embodiments, the method 800 may include rotating the wash basket within the wash tub. In such embodiments, measuring the humidity value may include measuring the humidity value with the humidity sensor while rotating the wash basket within the wash tub. When the wash tub and/or the wash basket therein include some residual moisture, e.g., remaining water or other wash liquid, rotating the wash basket may result in distributing the liquid around within the wash tub, such as spraying or splashing such liquids, thereby resulting in an increase in the measured humidity within the wash tub. For example, such motion may accelerate the vaporization of the liquids, e.g., through increased contact between the surface of the liquids and the air within the wash tub. Additionally, the increase in the measured humidity within the wash tub may be generally proportional to the temperature of the liquids and the speed of rotation of the wash basket, e.g., a larger increase in measured humidity for hotter liquids and/or faster rotation of the wash basket. However, it should be noted that high temperatures or high-speed rotations are not required, exemplary methods of the present disclosure may also effectively identify humidity sensor faults or verify accurate humidity readings with cooler wash liquids and/or slower rotations as well.

In various embodiments, where the method 800 includes rotating the wash basket while measuring the humidity, rotating the wash basket may include rotating the wash basket at a speed between about four hundred revolutions per minute (400 RPM) and about one thousand five hundred revolutions per minute (1500 RPM). In some embodiments, for example, such rotation may be or include rotating the wash basket as a part of a spin cycle of the washing machine appliance.

In some embodiments, the expected humidity value may be a spike, e.g., a rapid increase in humidity, such as spike 704 described above with respect to FIG. 7. As discussed above, the humidity within the wash tub may be expected to increase when water or other wash liquid is present within the wash tub and the wash basket is rotated. Thus, for example, the expected humidity value may be a spike in embodiments where the humidity value is measured while rotating the wash basket.

In some embodiments, method 800 may include flowing a volume of water into the wash tub prior to measuring the humidity value. In such embodiments, the expected humidity value is proportional to a temperature of the volume of water. For example, where the expected humidity value is a spike, a larger spike or more rapid increase in the humidity measurement may be expected for warmer water, as compared to an expected spike in humidity for cooler water may be smaller, e.g., a lower peak, and/or slower, e.g., a longer time to reach the peak value.

In various embodiments, method 800 may be incorporated into a standard cycle, such as any wash cycle, of the washing machine appliance. In additional embodiments, method 800 may also or instead be a special diagnostic cycle, or a part of a special diagnostic cycle. For example, as noted above, the special diagnostic cycle may include parameters which are suitable for testing one or more components of the washing machine appliance, such as the humidity sensor, but which are not optimal for cleaning laundry articles, such as flowing a relatively small volume of water into the wash tub in order to test the humidity sensor, where the volume of water may be less than would be used in washing a load of articles, and/or such as rotating the wash basket long enough to take and evaluate a humidity measurement, which may not be long enough to satisfactorily extract moisture from a load of articles. For example, the wash basket may be spun during a special diagnostic cycle only long enough to reach a peak value in a measured humidity and thereby evaluate the humidity sensor, without any additional spins during the diagnostic cycle such as would be included in a wash cycle.

In some embodiments, the washing machine may include ventilation features and may be operable to perform a ventilation cycle, such as is generally described above with reference to FIGS. 3 through 6. In such embodiments, the ventilation cycle may include a humidity target or threshold, e.g., the ventilation cycle may be terminated when the humidity threshold is reached. Accordingly, verifying the accuracy of the humidity sensor may permit the ventilation cycle to be based on the measured humidity, e.g., as opposed to running the ventilation cycle for a fixed, predetermined time. Thus, for example, some exemplary methods according to embodiments of the present disclosure may include terminating a vent cycle of the washing machine appliance based on the measured humidity value when the measured humidity value is within the predetermined threshold of the expected humidity value.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a cabinet, a wash tub positioned within the cabinet, a wash basket rotatably mounted within the wash tub, and a humidity sensor positioned and configured to measure a humidity within the wash tub, the method comprising:

measuring a humidity value within the wash tub with the humidity sensor;

comparing the measured humidity value within the wash tub to an expected humidity value within the wash tub, wherein the expected humidity value is a spike corresponding to an increase in humidity of at least thirty percentage points in three hundred seconds or less; and flagging a fault in response to the measured humidity value differing from the expected humidity value by at least a predetermined threshold, wherein the fault indicates the humidity sensor is not functioning accurately.

2. The method of claim 1, further comprising rotating the wash basket within the wash tub, wherein measuring the humidity value comprises measuring the humidity value with the humidity sensor while rotating the wash basket within the wash tub.

3. The method of claim 2, wherein rotating the wash basket comprises rotating the wash basket at a speed between about four hundred revolutions per minute and about one thousand five hundred revolutions per minute.

4. The method of claim 2, wherein rotating the wash basket is a part of a spin cycle of the washing machine appliance.

5. The method of claim 1, further comprising flowing a volume of liquid into the wash tub prior to measuring the humidity value, wherein the expected humidity value is proportional to a temperature of the volume of liquid.

6. The method of claim 1, wherein the method is a part of a special diagnostic cycle of the washing machine appliance.

7. The method of claim 1, further comprising terminating a vent cycle of the washing machine appliance based on the measured humidity value when the measured humidity value is within the predetermined threshold of the expected humidity value.

8. The method of claim 1, wherein the humidity sensor is positioned in a vent line of the washing machine appliance, the vent line extending between the wash basket and the cabinet downstream of the wash basket.

9. A washing machine appliance comprising:

a cabinet;

a wash tub positioned within the cabinet;

a wash basket rotatably mounted within the wash tub;

a humidity sensor positioned and configured to measure a humidity within the wash tub; and a controller, the controller operable for:

measuring a humidity value within the wash tub with the humidity sensor;

comparing the measured humidity value within the wash tub to an expected humidity value within the wash tub, wherein the expected humidity value is a spike corresponding to an increase in humidity of at least thirty percentage points in three hundred seconds or less; and flagging a fault in response to the measured humidity value differing from the expected humidity value by at least a predetermined threshold, wherein the fault indicates the humidity sensor is not functioning accurately.

10. The washing machine appliance of claim 9, wherein the controller is further operable for rotating the wash basket within the wash tub, wherein measuring the humidity value comprises measuring the humidity value with the humidity sensor while rotating the wash basket within the wash tub.

11. The washing machine appliance of claim 10, wherein rotating the wash basket comprises rotating the wash basket at a speed between about four hundred revolutions per minute and about one thousand five hundred revolutions per minute.

12. The washing machine appliance of claim 10, wherein rotating the wash basket is a part of a spin cycle of the washing machine appliance.

13. The washing machine appliance of claim 9, wherein the controller is further operable for flowing a volume of liquid into the wash tub prior to measuring the humidity value, wherein the expected humidity value is proportional to a temperature of the volume of liquid.

14. The washing machine appliance of claim 9, wherein the controller is configured to perform a special diagnostic cycle, the special diagnostic cycle comprising measuring the humidity value with the humidity sensor, comparing the measured humidity value to the expected humidity value, and flagging the fault in response to the measured humidity value differing from the expected humidity value by at least the predetermined threshold.

15. The washing machine appliance of claim 9, wherein the controller is further operable for terminating a vent cycle of the washing machine appliance based on the measured humidity value when the measured humidity value is within the predetermined threshold of the expected humidity value.

16. The washing machine appliance of claim 9, wherein the humidity sensor is positioned in a vent line of the washing machine appliance, the vent line extending between the wash basket and the cabinet downstream of the wash basket.

* * * * *